United States Patent [19]

Johnson

[11] Patent Number: 4,492,175

[45] Date of Patent: Jan. 8, 1985

[54] SAIL BOOM TENT

[76] Inventor: David E. Johnson, 1147 Sleepy Hollow Ct., Venice, Fla. 33595

[21] Appl. No.: 427,867

[22] Filed: Sep. 29, 1982

Related U.S. Application Data

[63] Continuation-in-part of Ser. No. 389,712, Jun. 18, 1982, abandoned.

[51] Int. Cl.[3] ..... B63H 9/00

[52] U.S. Cl. ..... 114/39; 114/97; 114/361; 135/88

[58] Field of Search ..... 114/39, 351, 361, 97, 114/98, 103, 105, 109; 135/87, 88, 90, 101, 102, 106

[56] References Cited

U.S. PATENT DOCUMENTS

| | | | |
|---|---|---|---|
| 93,770 | 8/1869 | Tibbett | 114/98 |
| 639,916 | 12/1899 | Achterberg | 114/105 |
| 3,291,090 | 12/1966 | Sevey | 114/109 |
| 3,298,346 | 1/1967 | Cochran | 114/103 |
| 3,698,409 | 10/1972 | Koontz et al. | 114/361 |
| 3,903,826 | 9/1975 | Anderson | 114/103 |
| 4,114,551 | 9/1978 | Hall | 114/98 |
| 4,347,799 | 9/1982 | Moriarty | 114/105 |

*Primary Examiner*—Sherman D. Basinger
*Attorney, Agent, or Firm*—Hauke and Patalidis

[57] ABSTRACT

In a watercraft such as a sailboat, wherein a boom is pivotally mounted to a mast and extends aft over an open cockpit, a plurality of fittings are mounted to the port and the starboard sides of the boom in a spaced apart manner. Elongate spreader members are removably carried by such fittings and they extend laterally outward over the open cockpit, terminating above the port and starboard sides of the cockpit. Flexible membranes are supported on the spreaders and flexible screening depends from the outboard edges of the membranes in such a manner that the screening surrounds the cockpit and the lower edge of the screening is held in place against the hull structure of said watercraft.

9 Claims, 10 Drawing Figures

SAIL BOOM TENT

CROSS REFERENCE TO RELATED APPLICATION

This application is a continuation-in-part of application Ser. No. 389,712 filed June 18, 1982 and now abandoned.

BACKGROUND OF THE INVENTION

The pleasure of owning and using a sailboat are well known, and such pleasure can be enjoyed the year round in southern areas where the sun shines most of the time year round, and during the summer months in more northern latitudes. One inconvenience, however, is the lack of shade to occupants of an open cockpit of such a sailboat, especially when it is at anchor or is tied up at a dock in a marina. The hot sun beating down on the occupants of the cockpit makes its use less desireable and unpleasant. Then too, some protection for the occupants from flying insects is also most welcome.

To these problems, there is a solution that, insofar as is known, has not been disclosed heretofore, but is described and claimed hereafter.

SUMMARY OF THE INVENTION

The present invention relates to sailboats and, more particularly, to apparatus for providing shade from the sun and side screening to keep flying insects away from the occupants of the cockpit of sailboats having a sail boom pivotally mounted to a mast forward of the cockpit with the boom extending aft thereof and above the cockpit. A sail boom tent is removably supported on elongate members extending outward port and starboard from the boom, and screening is removably secured to the boom tent material so that the screening drapes downward around the perimeter of the cockpit onto the topside surface of the sailboat.

For a further understanding of the invention and for features and advantages thereof, reference may be made to the following description and the drawings showing an embodiment of the invention.

DETAILED DESCRIPTION

Figure 1:
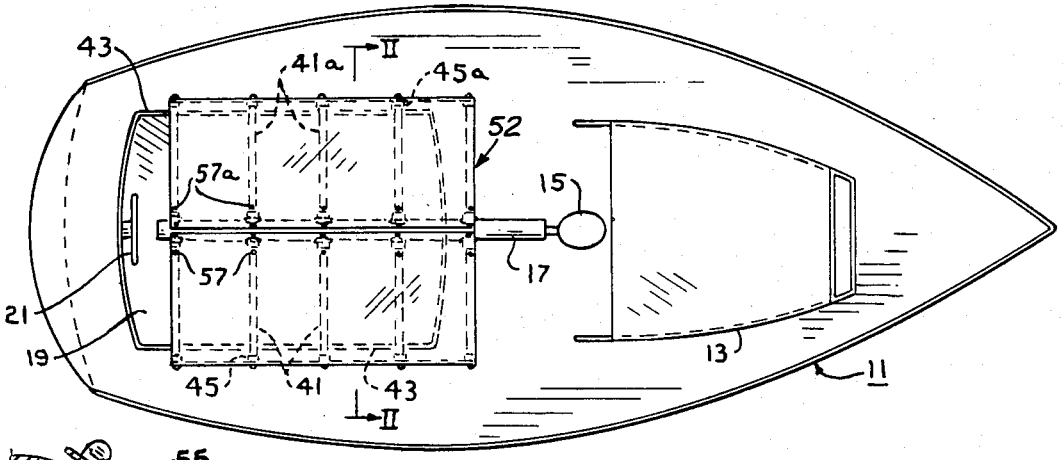
FIG. 1 is a schematic view of the deck of a conventional sailboat showing one embodiment of the invention in position over the cockpit thereof.

Referring to FIG. 1, the deck of sailboat 11 includes a cabin structure 13 and a mast 15, and pivotally mounted to the mast 15, in a conventional manner, is a boom 17 extending aft of the mast for almost the length of a cockpit 19. A steering device 21 is provided aft of the boom end as is customary.

Figure 2:
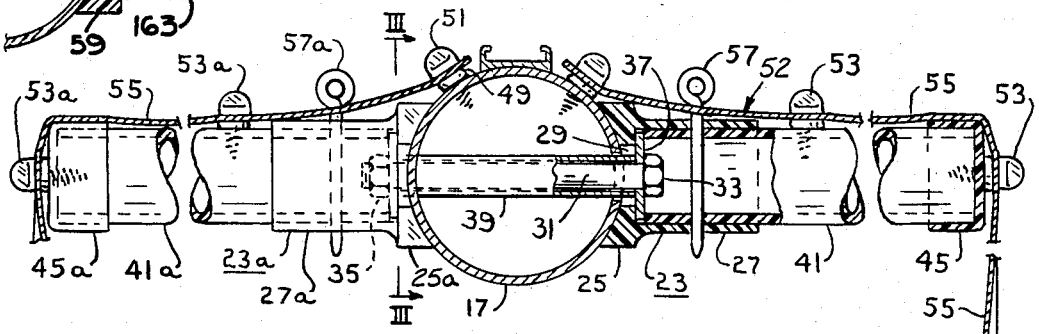
FIG. 2 is a view along line II—II of FIG. 1.
Figure 3:
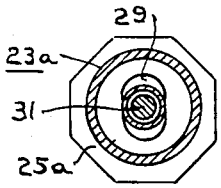
FIG. 3 is a view along line III—III of FIG. 2.

The boom 17, as shown in FIG. 2, is provided with fittings 23, 23*a* that are mounted to the sides of the boom 17 and project to both port and starboard therefrom. Each such fitting 23, 23*a* has an octagonal portion 25, 25*a*, though other shaped portions may be used if preferred, that is integrally formed with a tubular portion 27, 27*a*. The octagonal portions 25, 25*a* have oval shaped apertures 29 therein; through such apertures 29 extends a rod-like through bolt 31. One end of the through-bolt 31 has a standard hexagonal head portion 33, and the other end portion is threaded to receive a standard hexagonal nut 35. The bolt head 33 and the nut engage conventional washers 37. Extending through the boom 17 from port to starboard, between opposing fittings 23, 23*a* is a tubular member 39 surrounding the bolt shank 31. The tubular member 39 serves to prevent compression of and deformation to the boom 17 should the nut 35 be tightened excessively.

The boom fittings 23, 23*a* each slidably receive one end of a tubular member or tent support member 41, 41*a* that extends from the boom 17 to port and starboard generally perpendicular to the boom 17, to just about the coaming surrounding the open cockpit 19. The outer ends of such members 41, 41*a* are each provided with a cap 45, 45*a* that may be fitted into or over the end portions of the members 41, 41*a*.

Along the length of the boom 17, on both sides of a conventional sail track 47, there are on each side a row of spaced apart female halves of conventional snap fasteners 49. The male half 51 of each snap fastener 49 is fastened into the edges of the two halves of a boom tent 52 that is carried and supported by the several members 41, 41*a*.

The boom tent support members 41, 41*a* are also fitted with conventional fasteners of the thumb twist type 53, 53*a*, screwed into the top of the support members 41, 41*a* in a linear spaced apart manner. The thumb twist fasteners 53, 53*a* project through conventional apertures or slots in the boom tent material 55 that may be ordinary canvas or synthetic fiber material. In some instances the boom tent material may drape downward below the end of the support members 41, 41*a* to provide shade from the sun when it is low and near the horizon.

As shown in FIG. 2, eye-pins 57, 57*a* extend through the tent material 55, the fittings 23, 23*a* and the boom tent support members 41, 41*a*. The eye-pins 57, 57*a* are easily inserted through the several members and are easily removed when it is desired to stow the boom tent.

Figure 4:
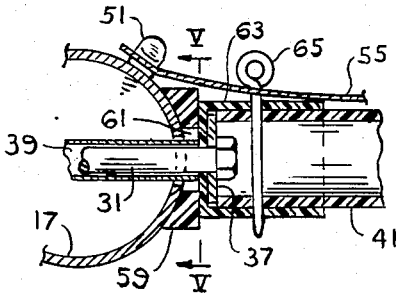
FIG. 4 is a view of a portion of the structure of FIG. 2 showing a modification thereof.
Figure 5:
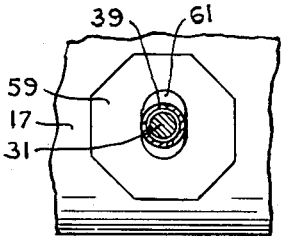
FIG. 5 is a view along line V—V of FIG. 4.

Referring to FIGS. 4 and 5 an alternative means for connecting support member 41 or 41*a* to the boom 17 is shown wherein, an octagonal fitting 59, made of plastic preferably, is fitted to the curvature of the boom 17. The fitting 59 is provided with a long oval aperture 61, and the through bolt 31, surrounded by the tubular member 39, extends through the aperture 61, and the tubular member abuts the washer 37. A receptacle 63 surrounds the washer 37, and the bolt head, and abuts the octagonal fitting 59. A boom tent material support member 41 is slidably received by the receptacle 63, and an eye-pin 65 is inserted through the tent material 55, the receptacle 63, and the support member 41. The tent material 55 is disposed on the boom 17 and the support members 41, 41*a* as shown and described previously herein.

Figure 10:
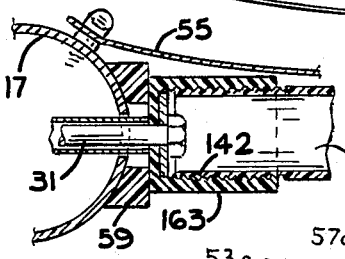
FIG. 10 is a view similar to FIG. 4, but showing coacting threads connecting one element to another element.

FIG. 10 illustrates another manner for receiving and securing boom tent supporting members in the boom fittings. Receptacles 163, like the receptacles 63, are mounted to the boom 17 and threaded ends 142 of support members 141. While only one side of the boom 17 has been shown, it is understood that the receptacles 163 exist on both sides, port and starboard, of the boom 17 with support members 141 extending both port and starboard from the boom 17.

In use, the several boom tent support members 41, 41*a* are each inserted into the support fittings or receptacles. Then, one may easily and quickly place the two halves of the boom tent material 55 on the respective support members 41, 41*a*. Commencing with the snap fasteners 53, 53*a* of the boom, one secures the tent material to the boom first. Then, working from the boom outboard port and starboard, the tent material may be secured to the support members by inserting the fasteners through the apertures in the tent material.

Figure 6:
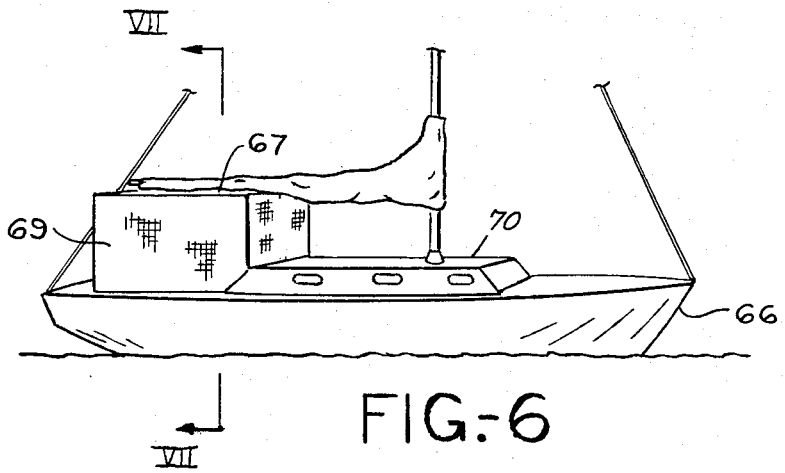
FIG. 6 is a schematic view of the sailboat fitted with a boom tent and insect screening in accordance with the invention.

FIG. 6 illustrates schematically another form of sailboat 66 as it appears afloat, fitted with a boom tent 67. Removably fitted to the boom tent 67 is a flexible woven mesh-type insect screening material 69, that may be of plastic or other suitable material.

Figure 8:
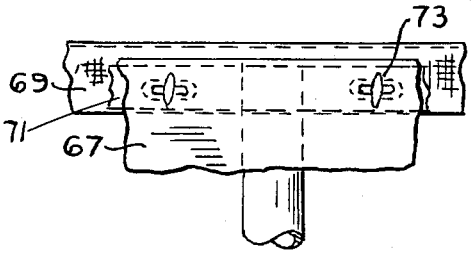
FIG. 8 is a view along line VIII—VIII of FIG. 7.

The upper edge of the screening material 69 is provided with a fabric tape 71 (FIG. 8) to which is attached, at spaced intervals, thumb twist fasteners 73, of conventional kind. The boom tent material 67 is perforated at corresponding intervals along its outer edge to receive the thumb twist fasteners 73, thereby securing the upper edge of the screening material 69 in place.

The screening or insect screening 69, drapes downward from the edge of the boom tent 67 (FIG. 6) and rests on the deck of the sailboat alongside the cockpit 19, port and starboard, at the forward end of the cockpit, if there is a cabin 70 the screening 69 is draped up and over the cabin roof.

Figure 7:
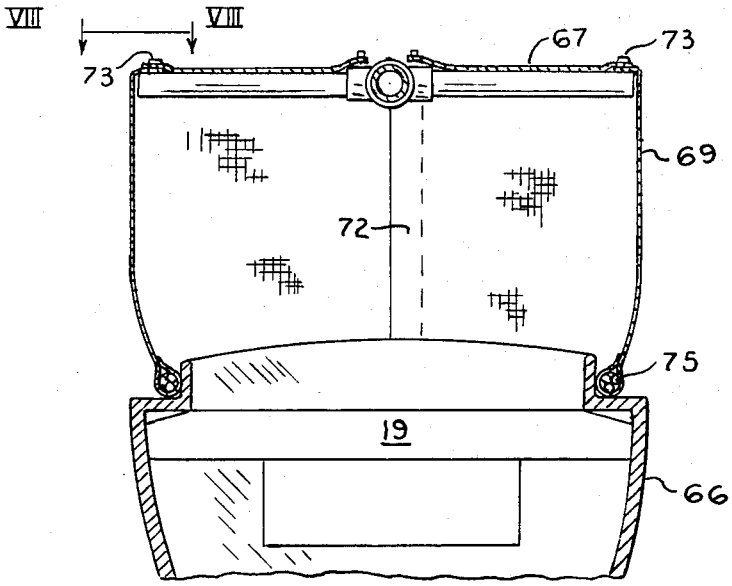
FIG. 7 is a view along line VII—VII of FIG. 6.

As shown in FIG. 7, a tent-type flap 72 may be provided in the screening, preferably aft, to afford access to and from the cockpit 19.

Figure 9:
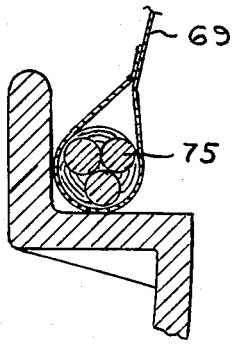
FIG. 9 is a view of a portion of the structure of FIG. 7.

In order to hold effectively the lower edge of the screening 69 in position, the lower edge may wrap around a continuous length of rope 75, as suggested in FIG. 9. In some instances, the continuous length of rope 75 may be replaced by a plurality of short lengths of rope, chain, or bars of metal or plastic. Then, if these members are spaced judiciously, the flexible screening may easily be draped on the deck and up and over the cabin roof.

Those who are skilled in the art will recognize from the foregoing description of the invention many features and advantages among which are:

That the boom tent material may be quickly and easily installed and removed and when removed it may be stowed either aboard the sailboat or ashore;

That the boom tent material may be synthetic fiber material that dries quickly and is light in weight and is easily rolled up for convenient stowage;

That the support members are thin walled plastic tubing that is strong, yet light in weight;

That the insect screening may be easily and quickly installed and when removed it may be easily rolled up or folded and stowed aboard the sailboat or ashore;

That the through bolts are surrounded by tubular members that prevent damage to the boom when the nut on the bolts is tightened; sometimes excessively;

That the boom tent material, if draped down at the sides and fore and aft can serve as a rain shield during a shower or a rain storm;

That the insect screening is easily held down on the deck and up and over a cabin if one is on the sailboat in a convenient manner as suggested hereinbefore; and That the sail boom tent may be used effectively when the wind is light even though the sail is set.

While the invention has been described herein with a certain degree of particularity, it is understood that the scope of the invention is defined by what is hereafter claimed.

What is claimed is:

1. In a sailboat wherein a sail boom is pivotally mounted to a mast and wherein said boom is hollow and extends aft from said mast over an open cockpit, in combination with said boom, a plurality of fittings mounted longitudinally in spaced apart relationship along both sides of said hollow boom, said fittings being adapted to hold elongate members extending laterally outboard on port and starboard sides from said fittings over said open cockpit and terminating above the port and starboard sides of said cockpit, means for fastening said fittings to said boom, said fastening means comprising a bolt and nut assembly extending through said hollow boom and coacting with opposite fittings, a tubular member surrounding said bolt and extending through said hollow boom for preventing excessive tightening of said nut over said bolt and deformation of said hollow boom, means for securing said elongate members each in a respective fitting, a first flexible membrane disposed on said elongate members extending on port side, a second flexible membrane disposed on said elongate members extending on starboard side, fastener means for removably securing each membrane to said hollow boom, and fastener means for removably securing said membranes respectively to said elongate port and starboard members.

2. The combination of claim 1 wherein said means for securing said elongate members each in a respective fitting comprises a pin disposed through aligned apertures in each of said fittings and each corresponding elongate member.

3. The combination of claim 1 wherein said means for securing said elongate members each in a respective fitting comprises mutually coacting screw threads on each elongate member and its corresponding fitting.

4. The combination of claim 1 comprising a cap over the outboard end of each elongate member and means on each cap for securing said membrane thereto.

5. The combination of claim 1 wherein at least one of said flexible membranes is made of canvas.

6. The combination of claim 1 wherein at least one of said flexible membranes is made of synthetic fibers.

7. The combination of claim 1 wherein at least one of said flexible membranes is woven in mesh form.

8. The combination of claim 1 further comprising a flexible screening removably secured to the outer edge of each of said flexible membranes and draping downward from said edge, and means coacting with said flexible screening for holding said screening lower edge at its lower edge in contact with a topside surface of said sailboat.

9. The combination of claim 8 wherein said means coacting with said screening lower edge is a length of rope disposed in a hem at said lower edge.

* * * * *